US007730725B2

(12) United States Patent
Faulder et al.

(10) Patent No.: US 7,730,725 B2
(45) Date of Patent: Jun. 8, 2010

(54) SPLASH PLATE DOME ASSEMBLY FOR A TURBINE ENGINE

(75) Inventors: Les Faulder, San Diego, CA (US); Mario E. Abreu, Poway, CA (US); Ram Srinivasan, San Diego, CA (US); Michael A. Lane, Spring Valley, CA (US)

(73) Assignee: Solar Turbines Inc., San Diego, CA (US)

( * ) Notice: Subject to any disclaimer, the term of this patent is extended or adjusted under 35 U.S.C. 154(b) by 426 days.

(21) Appl. No.: 11/898,679

(22) Filed: Sep. 14, 2007

(65) Prior Publication Data

US 2008/0066468 A1 Mar. 20, 2008

Related U.S. Application Data

(60) Provisional application No. 60/844,392, filed on Sep. 14, 2006.

(51) Int. Cl.
*F23R 3/50* (2006.01)

(52) U.S. Cl. ..... 60/752; 60/756

(58) Field of Classification Search ..... 60/752, 60/756; 431/159, 160, 174, 181, 187; 126/212, 126/220, 214 D, 214 C; 220/203.01, 203.11, 220/203.19, 203.27, 203.02, 203.29, 366.1
See application file for complete search history.

(56) References Cited

U.S. PATENT DOCUMENTS

| | | | | |
|---|---|---|---|---|
| 1,388,433 | A * | 8/1921 | Humphrey et al. | 431/348 |
| 1,457,506 | A * | 6/1923 | Dannreuther | 126/39 A |
| 1,820,277 | A * | 8/1931 | Klemme | 126/39 N |
| 4,356,693 | A * | 11/1982 | Jeffery et al. | 60/39.37 |
| 4,843,825 | A | 7/1989 | Clark | |
| 4,934,145 | A | 6/1990 | Zeisser | |
| 5,253,471 | A | 10/1993 | Richardson | |
| 5,271,219 | A | 12/1993 | Richardson | |
| 5,396,759 | A | 3/1995 | Richardson | |
| 5,490,389 | A | 2/1996 | Harrison et al. | |
| 5,974,805 | A | 11/1999 | Allen | |
| 6,032,457 | A | 3/2000 | McKinney | |
| 6,164,074 | A | 12/2000 | Madden et al. | |
| 6,497,105 | B1 | 12/2002 | Stastny | |
| 6,546,733 | B2 * | 4/2003 | North et al. | 60/772 |
| 6,792,757 | B2 | 9/2004 | Borns et al. | |
| 2004/0083735 | A1 | 5/2004 | Borns | |

FOREIGN PATENT DOCUMENTS

| | | |
|---|---|---|
| GB | 2247522 | 3/1992 |

* cited by examiner

*Primary Examiner*—Michael Cuff
*Assistant Examiner*—Vikansha S Dwivedi
(74) *Attorney, Agent, or Firm*—Finnegan, Henderson, Farabow, Garrett & Dunner

(57) ABSTRACT

A splash plate dome assembly for a combustion liner of a turbine engine is disclosed. The splash plate may include an outer periphery having a plurality of corners and an inner periphery defining an aperture and an annular flange. The splash plate may include a plurality of first flow guides extending from the outer periphery to the inner periphery. The splash plate may further include a plurality of second flow guides extending from the outer periphery to a location intermediate the inner periphery and the outer periphery. The splash plate, annular flange, first flow guides, and second flow guides may be integrally formed by casting. The splash plate may be mounted to a combustion dome having a plurality of distributed through holes for forming impingement jets on an upstream face of the splash plate.

16 Claims, 5 Drawing Sheets

SPLASH PLATE DOME ASSEMBLY FOR A TURBINE ENGINE

RELATED APPLICATIONS

The present disclosure claims the right to priority based on U.S. Provisional Patent Application No. 60/844,392 filed Sep. 14, 2006.

TECHNICAL FIELD

The present disclosure relates generally to improvements in the combustion liners of a gas turbine engine, and more particularly, to an improved splash plate dome assembly.

BACKGROUND

Gas turbine engines are often used as a power source for industrial machines, such as those used in the mining, manufacturing, gas, and oil industries, as well as for back-up power generation in utility or commercial applications. Typical gas turbine engines may use a compressor to provide compressed air to a combustion section. In some turbine engines, combustion sections may include a plurality of combustors (i.e., "can combustors") arranged annularly about a central shaft of the engine, each combustor having at least one fuel injector. Alternatively, a combustion section may include an annular combustor having a plurality of injectors disposed about an annular dome of the combustor. Compressed air may be mixed with fuel from the fuel injectors in the combustor and may be ignited by conventional means to generate combustion gases. The combustion gases may be discharged from the combustor into a turbine, which may extract energy from the gases to power various components of the engine and/or machine.

During operation, temperatures within the combustor may increase due to the exothermic combustion of the fuel/air mixture. The highest temperatures may be experienced by components located proximate the fuel injector. Accordingly, attempts have been made at providing cooling, coatings, and/or heat shields in the combustor liner for protecting combustor components from the thermal effects of combustion. Combustor components have also been cooled through impingement cooling methods wherein jets of cooling air are directed onto hot components of the combustor, or through film cooling.

For example, U.S. Pat. No. 5,490,389 to Harrison et al. ("the '389 patent") describes a combustor having a fuel injector disposed in the center of a heat shield mounted to a bulkhead or dome of the combustor. The bulkhead has a plurality of holes for providing a flow of air between the bulkhead and the heat shield, which creates an outwardly circulating flow of air. The heat shield has a plurality of angled cooling holes for directing some of the cooling air through the heat shield, and outward, across its downstream face in order to film cool the heat shield. The heat shield is also cooled by a plurality of pedestals mounted to its upstream face.

Although the '389 patent provides for some cooling of the heat shield, and creates an outwardly circulating flow of air, its ability to provide sufficient cooling with reduced emissions may be limited. In particular, the outward flow between the bulkhead and heat shield may be insufficient. Moreover, the holes in the heat shield may result in flame extinction and increased emissions, especially in a lean pre-mix system. Finally, the heat shield of the '389 patent may be expensive and difficult to manufacture, due to the numerous pedestals and holes.

In another example, U.S. Pat. No. 6,497,105 to Stastny ("the '105 patent") describes a combustor having a heat shield mounted to a bulkhead or dome of the combustor. Cooling air is directed from an annular gap around the fuel injector to the gap between the heat shield and the bulkhead. The heat shield has a plurality of holes for directing pressurized cooling air through the shield into the combustor chamber, in order to cool the bulkhead and heat shield. The heat shield also has a plurality of pins and inner and outer ridges extending outwardly away from the shield plate for increasing air contacting surfaces and forming air channels, respectively.

Although the '105 patent provides for some cooling of the heat shield, its ability to provide sufficient cooling with reduced emissions may be limited. Specifically, because cooling air is not directed from the periphery of the heat shield, and because the holes may allow cooling air to directly enter the combustion chamber, flame extinction may occur. Also, the numerous pins, ridges, and holes of the heat shield may require expensive and time consuming manufacturing techniques.

SUMMARY OF THE INVENTION

In one aspect, the present disclosure is directed to a splash plate for an annular combustor dome of a turbine engine, including an outer periphery having a plurality of corners and an inner periphery defining an aperture and an annular flange. The splash plate may further include a plurality of first flow guides extending from the outer periphery to the inner periphery. The splash plate may still further include a plurality of second flow guides, each extending from one of the corners to a position located radially inward relative to the outer periphery and radially outward relative to the inner periphery.

In another aspect, the present disclosure is directed to an annular combustor for a turbine engine, including an inner combustion liner, an outer combustion liner, a combustion dome, and a splash plate. The splash plate may include an outer periphery having a plurality of corners and an inner periphery defining an aperture and an annular flange. The splash plate may further include a plurality of first flow guides extending from the outer periphery to the inner periphery. The splash plate may still further include a plurality of second flow guides, each extending from one of the corners to a position located radially inward relative to the outer periphery and radially outward relative to the inner periphery.

DETAILED DESCRIPTION

Figure 1:
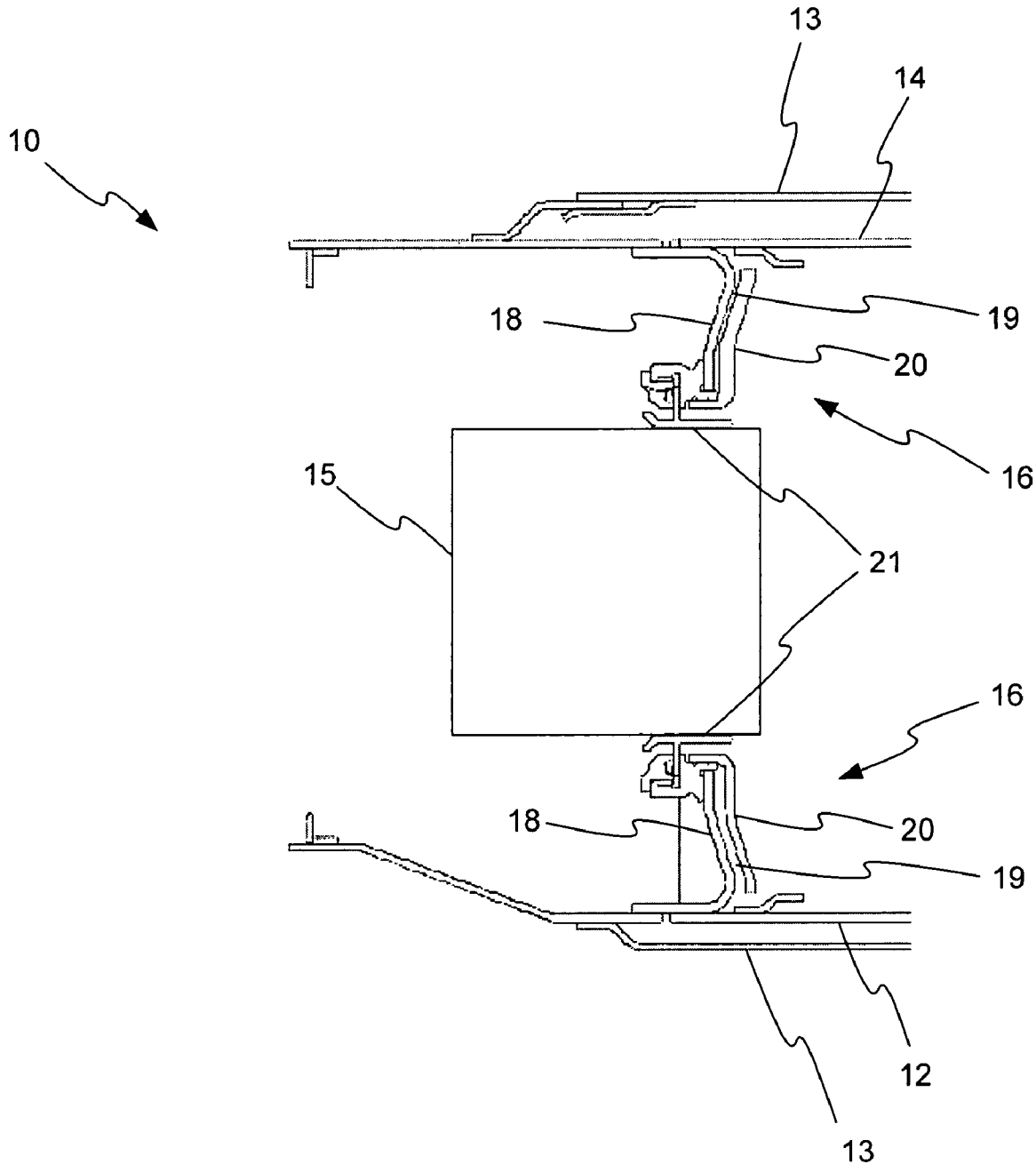
FIG. 1 is a cutaway-view representation of an exemplary disclosed combustor of a turbine engine.

FIG. 1 illustrates an exemplary annular combustor 10 of a turbine engine. In general, annular combustor 10 may combust a mixture of fuel and compressed air to create a mechanical work output. As illustrated in the cross-section of FIG. 1, exemplary annular combustor 10 may include an inner combustion liner 12, an outer combustion liner 14, one or more covers 13, and at least one fuel injector 15. Covers 13 may include, for example, a set of inner and outer impingement covers mounted to inner and outer combustion liners 12, 14. Inner combustion liner 12 and outer combustion liner 14 may each be in communication with a splash plate dome assembly 16 at an upstream end of the combustor.

Splash plate dome assembly 16 may include a "bulkhead", or annular dome 18, a plurality of splash plates 20, and a plurality of floating shrouds 21. Dome 18 may be an annular sheet of metal mounted at an outer periphery to outer combustion liner 14 and at an inner periphery to inner combustion liner 12. Dome 18 may also be disposed to carry each fuel injector 15 of the combustor, for example, such that each fuel injector 15 extends through a radially disposed aperture of dome 18. In one embodiment, dome 18 may further include a plurality of distributed through-holes (not shown), configured to provide air passageways from an upstream face of dome 18 to a downstream face of dome 18.

Each splash plate 20 may be mounted to a floating shroud 21. Floating shroud 21 may be an annular, substantially T-shaped flange or grommet, which may be fixed to dome 19 and disposed about a fuel injector 15. In one embodiment, floating shroud 21 may be movably disposed to translate axially relative to fuel injector 15 and radially relative to the rest of splash plate dome assembly 16. Accordingly, floating shroud 21 may accommodate the expansion and relative motion between components of annular combustor 10, which result from extreme temperatures and stresses. Splash plate 20 may be mounted to floating shroud 21 so as to create a gap 19 between dome 18 and splash plate 20. Splash plate 20 may alternatively be mounted to inner and/or outer combustion liners 12, 14, or any other nearby component sufficient for providing a desired gap 19 between dome 18 and splash plate 20.

In general, because dome 18 may include through-holes 17, cooling air located upstream from splash plate dome assembly 16 may pass through dome 18 into gap 19. Cooling air in gap 19 may then be directed radially outward by splash plate 20 towards inner and outer combustion liners 12, 14 of annular combustor 10. Attention will now be directed to the particular features and advantages of splash plate 20.

Figure 2A:
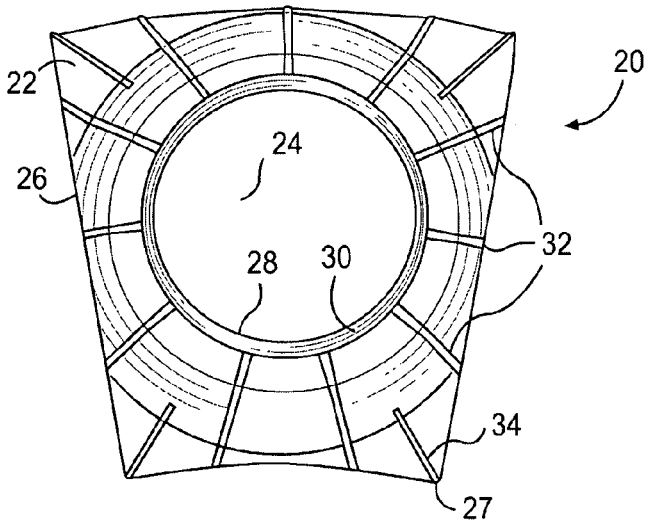
FIG. 2A is a downstream view representation of the exemplary disclosed splash plate.
Figure 2B:
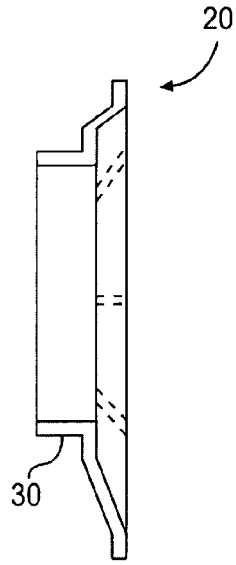
FIG. 2B is a side view representation of the exemplary disclosed splash plate.
Figure 2C:
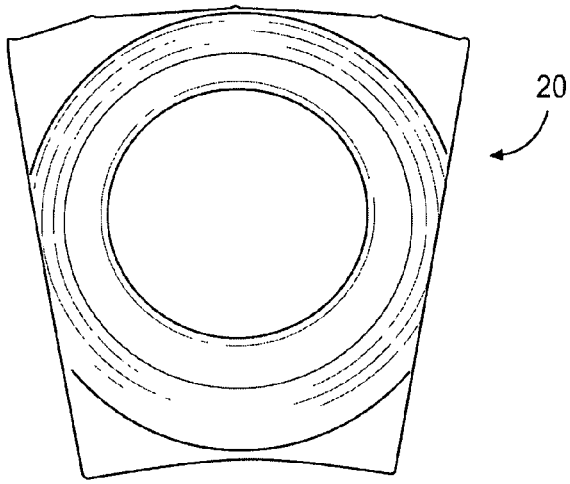
FIG. 2C is an upstream view representation of the exemplary disclosed splash plate.

Exemplary splash plate 20 is illustrated in FIGS. 2A-2C having an upstream, "cold side" shown in FIG. 2A, a profile view shown in FIG. 2B, and a downstream, "hot side" shown in FIG. 2C. The cold side of splash plate 20 may face dome 18. The hot side of splash plate 20 may face the combustion chamber of annular combustor 10. In one embodiment, splash plate 20 may include a metal plate having, in some respects, dimensions similar to those of a section of dome 18. For example, splash plate 20 may include a stamped, cast, or forged metal plate 22 having a central aperture 24. Splash plate 20 may have a substantially annular shape defined by an outer periphery 26 having a plurality of corners 27, and an inner periphery 28. In one embodiment, outer periphery 26 may be defined by an upper arc and a lower arc joined by two side edges, such that the radii of both arcs and the edges theoretically intersect a common remote point (e.g., a center point of a combustor). Therefore, an assembly of adjacent splash plates 20 may form an annular shape corresponding to dome 18. Inner periphery 28 may include an annular flange 30, which defines the perimeter of central aperture 24. Similar to each section of dome 18, aperture 24 of splash plate 20 may be configured to have fuel injector 15 disposed therein.

As illustrated in FIG. 2A, the cold side of splash plate 20 may include a plurality of first flow guides 32. First flow guides 32 may extend from the outer periphery 26 of splash plate 20 to the inner periphery 28 of splash plate 20. More specifically, first flow guides 32 may be integral with the metal plate 22 at the outer periphery 26 and integral with the annular flange 30 at the inner periphery 28. First flow guides 32 may be integrally cast or forged with splash plate 20. In one exemplary embodiment, splash plate 20 may include a number of first flow guides in the range of six to eighteen. In another exemplary embodiment, splash plate 20 may include a number of first flow guides in the range of ten to twelve.

Splash plate 20 may also include a plurality of second flow guides 34. Each second flow guide 34 may extend from a corner 27 at the outer periphery 26 of splash plate 20 to a location radially inward from outer periphery 26 and radially outward from inner periphery 28. In the embodiment of FIG. 2A, splash plate 20 may include four corners 27 and four corresponding second flow guides 34. As with first flow guides 32, second flow guides 34 may be integrally cast or forged with the metal plate 22 of splash plate 20. First and second flow guides 32, 34 may thereby form the exemplary "hub-and-spoke" arrangement illustrated in FIG. 2A.

As illustrated in FIG. 2B, splash plate 20 may have a slightly contoured profile configured to mate with a section of dome 18. For instance, annular flange 30 may be slightly depressed, or lower than the periphery of splash plate 20. The region surrounding annular flange 30 may therefore be angled downwards to achieve this geometry. The particular angles of splash plate 20 may be advantageous to airflow in gap 19, as will be described in greater detail below.

As illustrated in FIG. 2C, the hot side of splash plate 20 may be substantially smooth and configured to withstand the combustion environment. For example, the hot side of splash plate 20 may include a thermal barrier coating. In one embodiment, the hot side of splash plate 20 may be grit blasted in preparation for application of the coating. Grit blasting, or any similarly suitable methods, may clean and roughen the surface to make the coating more easily and permanently applied. Any decrease in stiffness caused by this process may be minimized by structural support from first and second flow guides 32, 34.

Figure 3A:
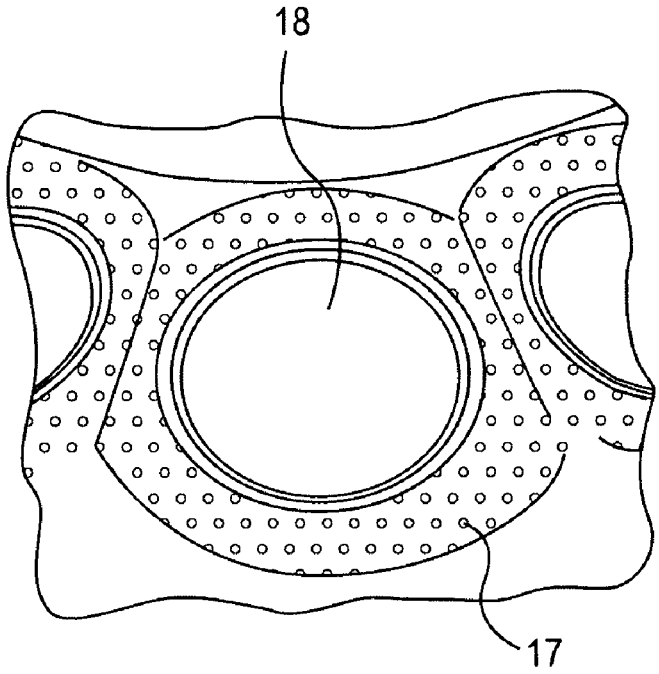
FIG. 3A is a perspective view representation of the exemplary disclosed annular combustion dome.
Figure 3B:
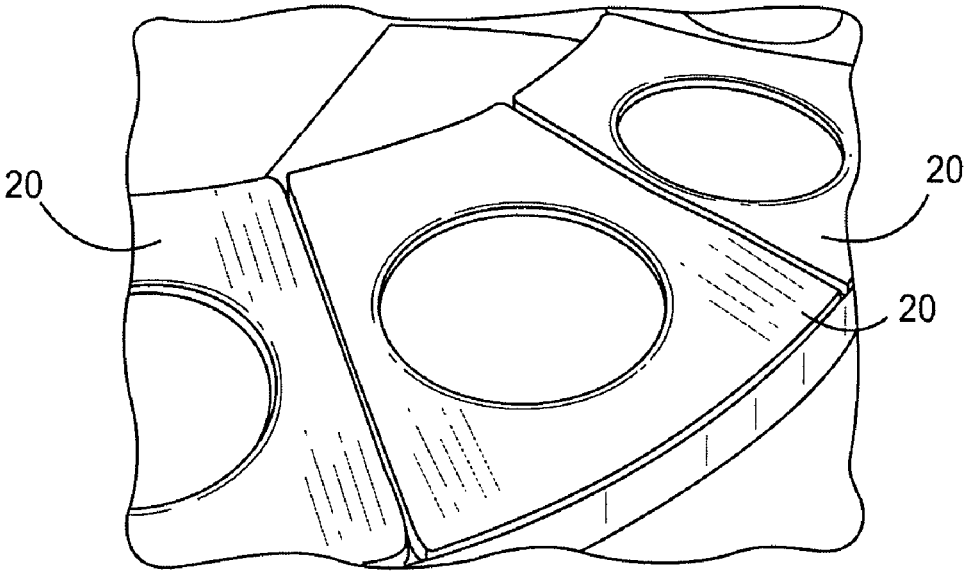
FIG. 3B is a perspective view representation of the annular combustion dome of FIG. 3A having an annular arrangement of exemplary disclosed splash plates mounted thereto.

FIG. 3A illustrates a portion of dome 18 wherein each adjacent section of the annular dome may be configured to receive a corresponding fuel injector and a corresponding splash plate 20. As illustrated, dome 18 may include a plurality of through-holes 17, which may be configured to provide fluid access from an upstream face of dome 18 to a cold side of each splash plate 20. FIG. 3B illustrates dome 18 having been covered by an annular arrangement of protective splash plates 20, each splash plate 20 mounted to a corresponding section of dome 18 and configured to receive its respective fuel injector (not illustrated).

Figure 4:
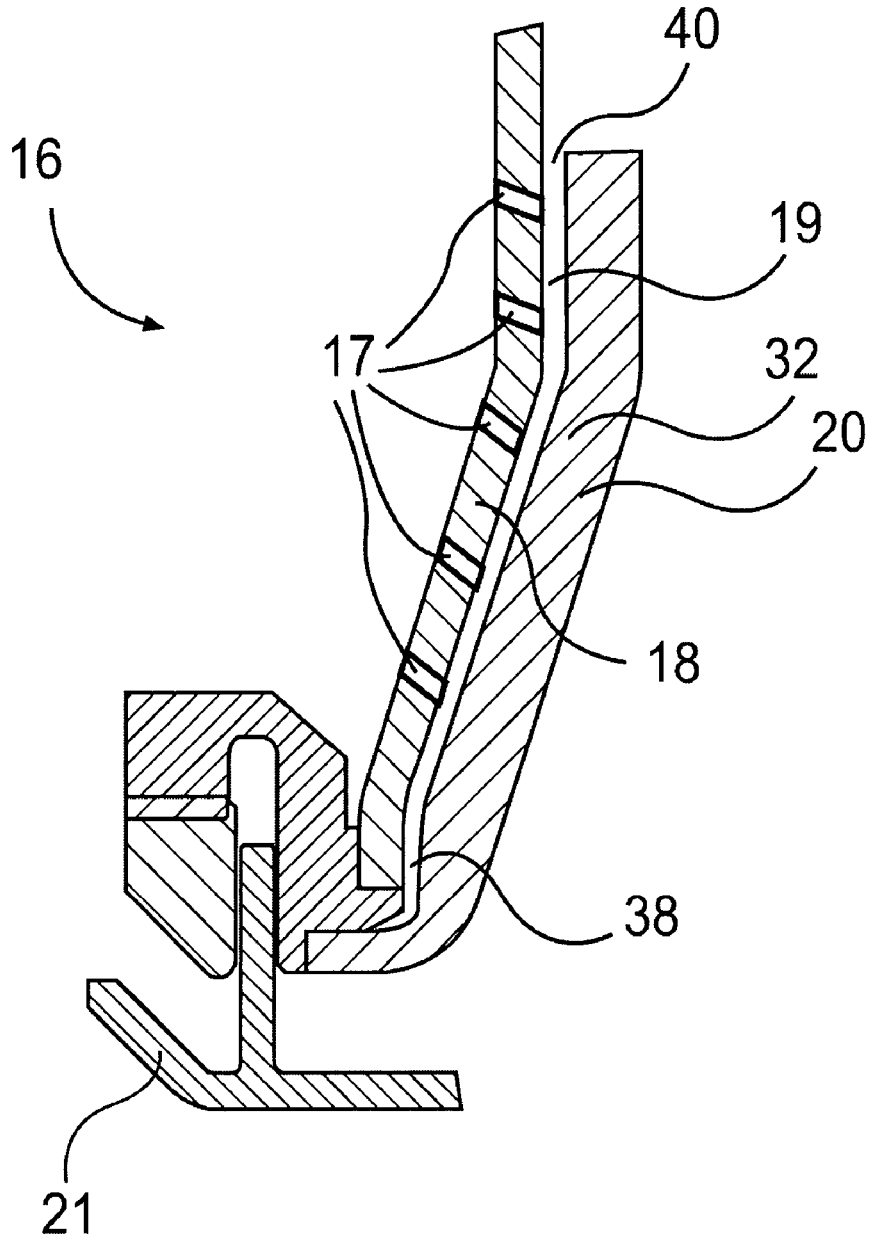
FIG. 4 is a cross-sectional view representation of the exemplary disclosed splash plate dome assembly.

FIG. 4 illustrates a partial, cross-sectional view of an exemplary splash plate dome assembly 16 in which dome 18 may include through-holes 17, and splash plate 20 may include integral flow guides 32. Specifically, FIG. 4 illustrates a cross-sectional view through the center of a flow guide 32 that is integral with splash plate 20 (e.g., as shown in the top half of FIG. 1). Splash plate 20 may be mounted to dome 18 via floating shroud 21 (as illustrated) or via any adjacent component so as to create a suitable gap 19 between dome 18 and splash plate 20. Accordingly, cooling air may enter gap 19 via through-holes 17 and travel, radially, outwardly through the channels created by flow guides 32, in the direction from point 38 to peripheral exit 40. The width of gap 19 and diameters of holes 17 may be sized to obtain a desired impingement heat transfer coefficient based on the amount of cooling airflow to be used. In one embodiment, both first flow guides 32 and second flow guides 34 may be as thick as possible. More specifically, the flow guides may be less deep than gap 19 only by an amount necessary to account for thermal growth of the flow guides and splash plate 20 due to hot combustion gases. In one embodiment, the thicknesses of first and second flow guides 32, 34 may be equal to each other and less than a than a thickness of annular flange 30. In another embodiment, the thicknesses of first and second flow guides 32, 34 may be approximately 0.25 inches.

As will be understood by one of skill in the art, although FIG. 4 illustrates an exemplary embodiment of splash plate dome assembly 16, any suitable arrangement for affixing dome 18 and splash plate 20 in relative engagement with floating shroud 21 and/or combustion liners 12, 14, is contemplated within the scope of the present disclosure.

Figure 5:
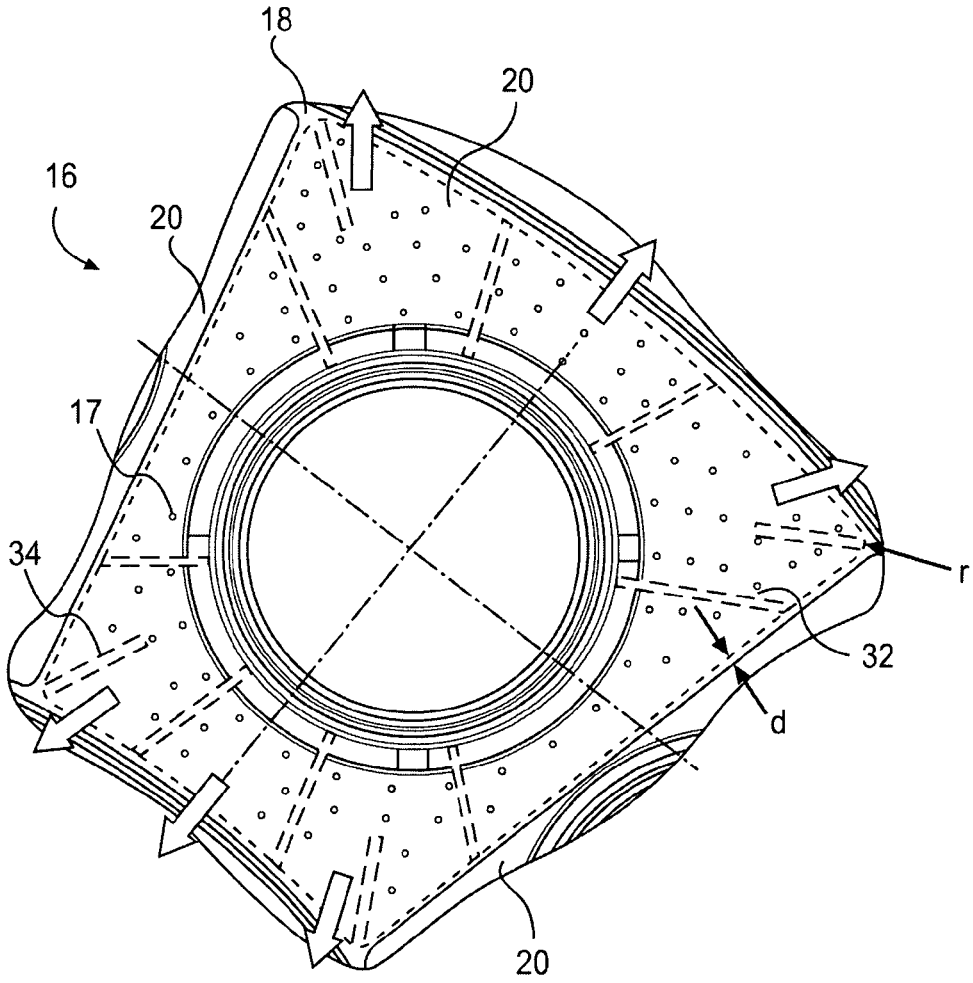
FIG. 5 is an assembly view representation of the exemplary disclosed splash plate dome assembly.

FIG. 5 illustrates a downstream view of the exemplary splash plate dome assembly 16 in which splash plate 20 and flow guides 32, 34 are illustrated in dashed lines as being disposed behind, or downstream from, dome 18. In one embodiment, through-holes 17 of dome 18 may be disposed in increasing density at locations closer to the outer periphery of splash plate 20. Moreover, splash plate 20 is illustrated having a radius, r, defining each of its corners 27. The radius r of each corner 27 of adjacent splash plates 20 may be reduced to decrease the local gaps between corners of adjacent splash plates. Still further, when assembled, a distance, d, may define the gap between adjacently disposed splash plates 20, as illustrated in FIG. 5. In one embodiment, d may be less than 0.25 inches. Alternatively, d may be defined by the width of gap 19 between dome 18 and splash plate 20, as shown in FIGS. 4A and 4B.

INDUSTRIAL APPLICABILITY

The disclosed splash plate, splash plate dome assembly, and combustor may be applicable to any turbine engine where improved fuel efficiency and reduced NOx emissions are desired. The operation of annular combustor 10, splash plate dome assembly 16, and splash plate 20 will now be described.

During operation of a turbine engine, air may be drawn in and compressed via a compressor section (not illustrated). This compressed air may then be directed to combustor section including an annular combustor 10 to be mixed with fuel for combustion. As the mixture of fuel and air enters combustion chamber, it may ignite and fully combust. The hot expanding exhaust gases may then be expelled into a turbine section (not illustrated), where the thermal energy of the combustion gases may be converted to rotational energy of turbine rotor blades and a central shaft.

More specifically, referring to FIGS. 1 and 4, compressed air from an upstream location, such as a compressor section of the turbine, may pass through holes 17 of dome 18 to enter gap 19. Accordingly, holes 17 may define an array of impingement cooling jets that strike the upstream cold side of splash plate 20. The increasing density of holes 17 at the periphery of splash plate 20 may bias the introduction of air flow in certain directions, as desired. Cooling air in gap 19 may be confined between dome 18 and splash plate 20, and at least partially constrained by flow guides 32, 34. Because flow guides 32, 34 extend radially, they may minimize a natural tendency towards radial swirling of air in gap 19. Moreover, because flow guides 32, 34 occupy volume in gap 19, they reduce the cross-sectional area through which cooling air may travel in its passage towards the periphery of splash plate 20. The reduction of available volume in gap 19, without a corresponding reduction in actual volumetric air flow, may result in an increase in flow velocity. Such an increase in airflow velocity may have several advantages.

First, an increase in the rate of radially exiting airflow may increase the convective rate of cooling of dome 18 and splash plate 20. Moreover, an increase in airflow velocity may create a pressure drop across the peripherally exiting flow (i.e., from point 38 to peripheral exit 40 in FIG. 4A). Because of the increase in flow velocity and pressure drop, previously existing irregularities in static pressure distribution at the periphery of the splash plate may be minimized or eliminated. Specifically, first and second flow guides 32, 34 may direct airflow outwards across the entire radius of the splash plate 20 in a way that minimizes "dead zones" or pockets of trapped air. This may result in the prevention of primary zone hot combustion gas injection in gap 19. These improvements in cooling may prevent prohibitive metal temperatures (e.g., 2100° F. and above) in the dome and splash plate.

Secondly, the increased rate of airflow and the angle of splash plate 20 may result in cooling airflow being further directed along inner and outer combustion liners 12, 14. Because this secondary direction of cooling airflow may act as a barrier between the flame and the combustion liner, flame attachment and prohibitive heat loads may be minimized or prevented at locations downstream from dome 18. Accordingly, the reuse of cooling airflow at this downstream location may obviate the need for an additional supply of cooling airflow at this location.

The above disclosed splash plate and assembly may therefore reduce the cooling airflow requirement. Because excessive cooling airflow has been linked to flame extinction (especially lean blow out) and increased CO emissions, the presently disclosed splash plate may be especially advantageous.

Further, the disclosed splash plate and assembly may prevent unwanted flow migration. Specifically, because the radius, r, of corners 27 may be tightened, or decreased, the gaps between adjacent splash plates at their corners may be reduced. Tighter assembly between adjacent splash plates may further prevent ingestion of primary zone hot combustion gases into gap 19. Further to this goal, the incorporation of second flow guides 34 at corners 27 may stiffen corners 27 so as to maintain a close gap tolerance, as intended, between adjacent splash plates. Second flow guides 34 may also prevent cross-flow of cooling air between the dome and the splash plate, where it is most pervasive (e.g., at the periphery of the splash plate).

In addition to flow enhancement, flow guides 32, 34 may be advantageous to stiffening splash plate 20 during various manufacturing processes, such as grit blasting and coating. Stiffness of splash plate 20 is also advantageous to operation in high temperature conditions of annular combustor 10. Thus, splash plate 20 may be especially resistant to deformation from its originally intended design profile.

The presently disclosed splash plate and assembly also enjoy advantages of increased ease and cost-effectiveness of manufacturing. For instance, integral casting of flow guides into splash plate 20 may be significantly easier and cheaper because flow guides need not be separately manufactured and brazed to the dome or splash plate. The need to form flow guide attachment slots in the splash plate may also be eliminated. Moreover, by integrally casting flow guides 32, 34 with splash plate 20, the distribution of through-holes 17 in dome 18 may be uninterrupted.

It will be apparent to those skilled in the art that various modifications and variations can be made to the disclosed annular combustor and splash plate. Other embodiments will be apparent to those skilled in the art from consideration of the specification and practice of the disclosed combustor and turbine engine. It is intended that the specification and examples be considered as exemplary only, with a true scope being indicated by the following claims and their equivalents.

What is claimed is:

1. A splash plate for a combustion dome of a turbine engine, comprising:

an outer periphery having a plurality of corners;

an inner periphery defining an aperture and an annular flange;

a plurality of first flow guides extending from the outer periphery of the slash plate to the inner periphery of the splash plate; and, a plurality of second flow guides, each extending from one of the corners to a position located radially inward relative to the outer periphery and radially outward relative to the inner periphery.

2. The splash plate of claim 1, wherein the plurality of corners includes four corners and wherein the plurality of second flow guides includes four second flow guides.

3. The splash plate of claim 1, wherein the splash plate, annular flange, first flow guides, and second flow guides are integrally formed by casting.

4. The splash plate of claim 1, wherein the first flow guides and second flow guides extend in radial directions to form a hub and spoke arrangement.

5. The splash plate of claim 1, wherein the thicknesses of the first flow guides and second flow guides are equal, and less than a thickness of the annular flange.

6. The splash plate of claim 1, wherein a region around the annular flange is angled such that the annular flange is depressed from the outer periphery of the splash plate.

7. The splash plate of claim 1, wherein the plurality of first flow guides includes between six and eighteen first flow guides.

8. The splash plate of claim 7, wherein the plurality of first flow guides includes between ten and twelve first flow guides.

9. A combustor for a turbine engine, comprising:

an inner combustion liner;

an outer combustion liner a combustion dome; and a splash plate, including:

an outer periphery having a plurality of corners;

an inner periphery defining an aperture and an annular flange;

a plurality of first flow guides extending from the outer periphery to the inner periphery; and, a plurality of second flow guides, each extending from one of the corners to a position located radially inward relative to the outer periphery and radially outward relative to the inner periphery.

10. The combustor of claim 9, wherein the combustion dome includes a distribution of a plurality of through holes.

11. The combustor of claim 10, wherein the distribution of through holes is denser at locations proximate the outer periphery of the splash plate.

12. The combustor of claim 9, wherein a contour of the splash plate is substantially similar to a contour of a section of the combustion dome.

13. The combustor of claim 12, wherein the splash plate is separated from the combustion dome by a distance of less than 0.25 inches.

14. The combustor of claim 12, wherein both the splash plate and the combustion dome generally extend between the combustion liners and at least one fuel injector of the combustor.

15. The combustor of claim 14, wherein the splash plate and combustion dome are both contoured such that they approach the at least one fuel injector at locations upstream in the combustion from where they approach the combustion liners.

16. The combustor of claim 15, wherein the inner periphery of the splash plate is movably engaged with the fuel injector and the outer periphery of the splash plate approaches the combustion liners.

* * * * *